United States Patent [19]

Melnyk

[11] 4,382,464

[45] May 10, 1983

[54] RADIATOR

[75] Inventor: William Melnyk, Lathrup Village, Mich.

[73] Assignee: Ex-Cell-O Corporation, Troy, Mich.

[21] Appl. No.: 292,311

[22] Filed: Aug. 12, 1981

[51] Int. Cl.[3] ..... F28F 7/00

[52] U.S. Cl. ..... 165/76; 165/149

[58] Field of Search ..... 165/149, 76, 67; 180/68 R, 68 P; 29/157.3 R, 157.4

[56] References Cited

U.S. PATENT DOCUMENTS

| | | | |
|---|---|---|---|
| 1,465,607 | 8/1923 | McCoy et al. | 165/149 |
| 1,570,142 | 1/1926 | Harris et al. | 165/149 |
| 2,932,489 | 4/1960 | Young | 165/149 |
| 3,165,151 | 1/1965 | Astrup et al. | 165/149 X |

*Primary Examiner*—William R. Cline
*Assistant Examiner*—Peggy A. Loiacano
*Attorney, Agent, or Firm*—John P. Moran

[57] ABSTRACT

The radiator illustrated includes a core assembly with a headsheet, gasket and tank bolted on the top and bottom ends thereof, as well as side channels for the opposite sides thereof. A "horseshoe" shaped bracket is secured to the headsheet and tank at each corner of the radiator. Each pair of upper and lower brackets is adapted to having one of the side channels removably mounted thereon and is further adapted to permitting repair of any corner leaks without having to break the tank-to-headsheet sealed joint to remove the side channel therefrom.

6 Claims, 3 Drawing Figures

RADIATOR

TECHNICAL FIELD

This invention relates generally to radiators and, more particularly, to an improved bolted tank radiator arrangement wherein repairs for leaks occurring between the headsheet and core assembly may be made without breaking the seal between the tank and headsheet.

BACKGROUND ART

In bolted tank radiator manufacturing practice, it is customary to bolt up the complete assembly and then conduct a leak test. If the radiator has leaks in the corners that are difficult to repair, the side channels are removed and reinstalled after the leak is repaired.

In some cases, the channels are not installed, but the bolts that attach the channels to the tanks are installed. This provides a sealed joint between the and tank and headsheet. After leak testing and repair, if necessary, the bolts holding the tank in the channel area are removed and the channel installed.

These practices are undesirable for the reasons that (1) the sealed joint between the tank and gasket can be opened or unsealed, producing a subsequent leak, or (2) the installation of the channel may, at times, prestress the end tube-to-headsheet joint and break the seal between the tube and the headsheet. Partially adjustable side channels have been used to eliminate the possibility of prestressing. However, in the event of leaks, the channels must be completely removed to permit the repair work.

In both cases, the operation of removing the channels for repair purposes, or removing the bolts to install the channel after test is time consuming.

DISCLOSURE OF THE INVENTION

Accordingly, a general object of the invention is to provide an improved bolted radiator arrangement, wherein testing and repair of corner leaks may take place prior to assemblying the side channel, and without having to break the sealed joint between the tank and the headsheet.

Another object of the invention is to provide "U" shaped corner brackets secured to each of the top and bottom bolted radiator headsheets, and side channels having a plurality of vertical slots formed therein for cooperation with fastening means formed in vertically extending flange portions of the brackets, permitting the side channels to be removed to permit repair of any corner leaks and then replaced without any sealing bolts having to be removed from the tank-headsheet-bracket connection.

These and other objects and advantages of the invention will be apparent when reference is made to the following description and accompanying drawings.

BEST MODE OF CARRYING OUT THE INVENTION

Figure 1:
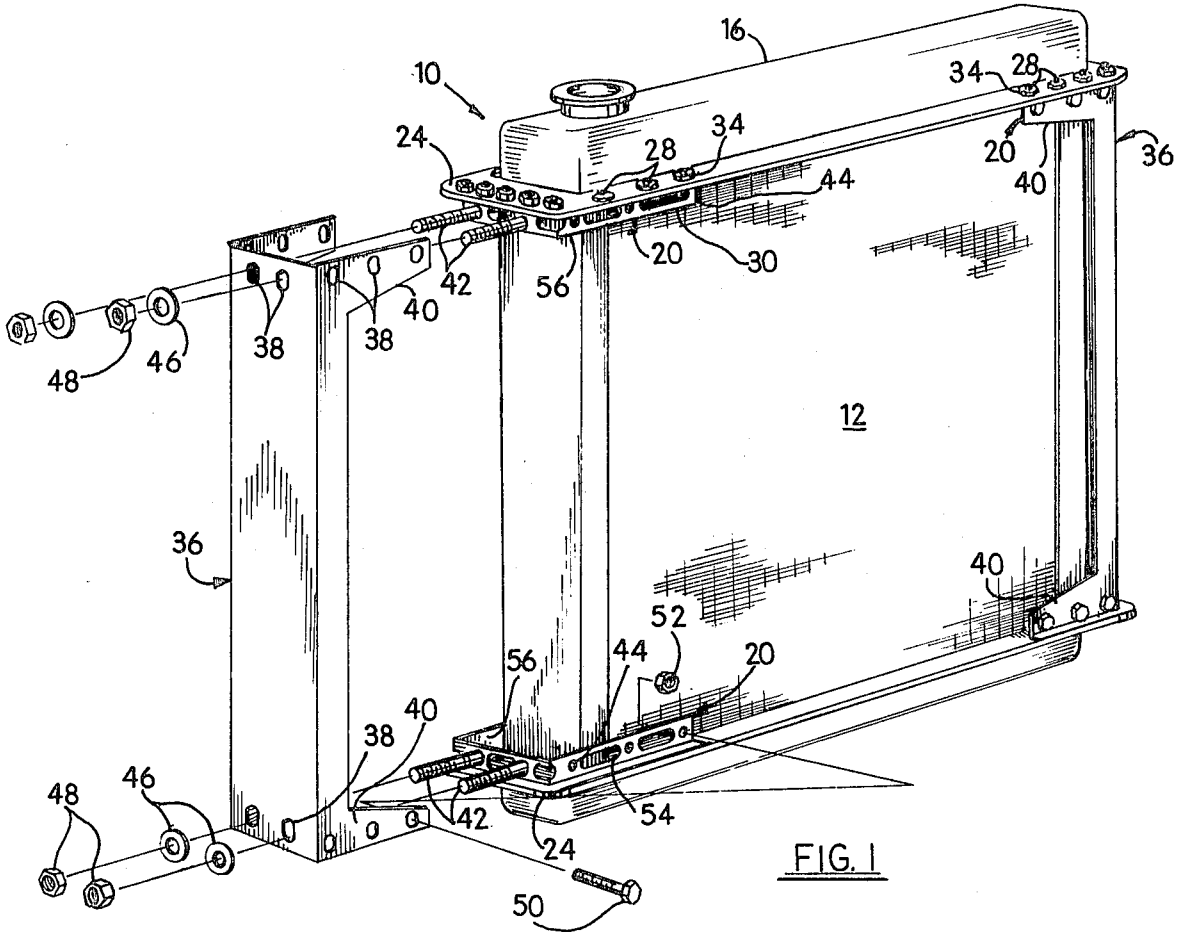
FIG. 1 is a front elevational view of an improved radiator assembly embodying the invention and showing one side channel removed therefrom.
Figure 2:
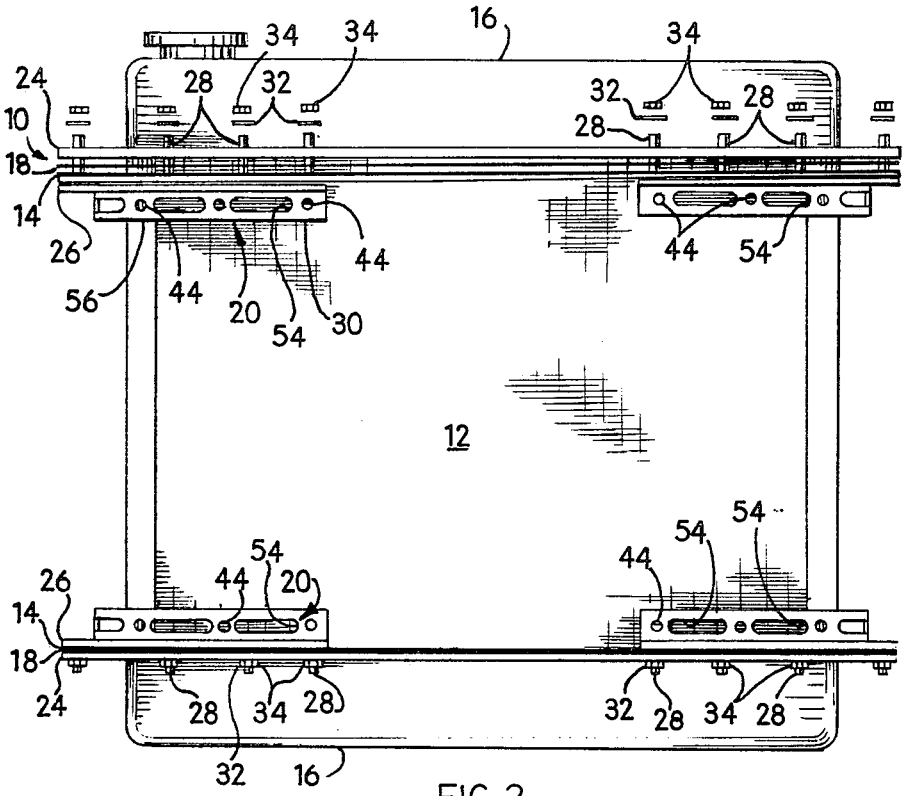
FIG. 2 is an exploded view of a corner portion of a radiator embodying the invention.

Referring now to the drawings in greater detail, FIGS. 1 and 2 illustrate a radiator 10 including a core assembly 12, a pair of headsheets 14, one of which is secured to the top and the other to the bottom of the core assembly by any conventional means, and top and bottom tanks 16 separated from the respective headsheets 14 by gaskets 18.

A "U" shaped bracket 20 is mounted at each of the four corners of the radiator 10, and secured thereon by any suitable fastener means extended through aligned openings formed in a horizontal flange 24 of the tank 16, the gasket 18, the headsheet 14 and a horizontal flange 26 of the bracket 20. One suitable fastening means may consist of studs 28 (FIG. 3) attached to the horizontal flange 26 of the bracket 20 so to extend vertically therefrom, in the opposite direction from a vertical flange 30 of the bracket 20, and adapted to extend through the openings of the headsheet 14, the gasket 18 and the flange 24 of the tank 16, and be secured by washers 32 and nuts 34.

In either arrangement, once assembled, the brackets, headsheets, gaskets and tanks need not be disassembled should it become necessary to repair corner leaks, as will be explained.

A side channel 36 is mounted against the vertical flanges 30 of the upper and lower brackets 20 on each side of the radiator 10, intermediate the horizontal flanges 26. A plurality of vertical slots 38 are formed around the top and bottom mounting flanges 40 of the side channel for cooperation with a plurality of studs 42 and/or openings 44 formed around each bracket 20. Any suitable mounting means may be employed for securing the side channel 36 to a pair of upper and lower brackets 20, such as the studs 42 formed on the ends of each bracket 20 with washers 46 and nuts 48 fastened thereto, in conjunction with bolts 50 and nuts 52 securing the side channel to the sides of the pair of brackets 20, inasmuch as the vertical flange 30 of each bracket 20 is spaced apart from the core assembly 12, permitting the nut 52 to be positioned therebetween. The brackets 20 thus serve as a connector means between the side channels 36 and headsheets 14.

Figure 3:
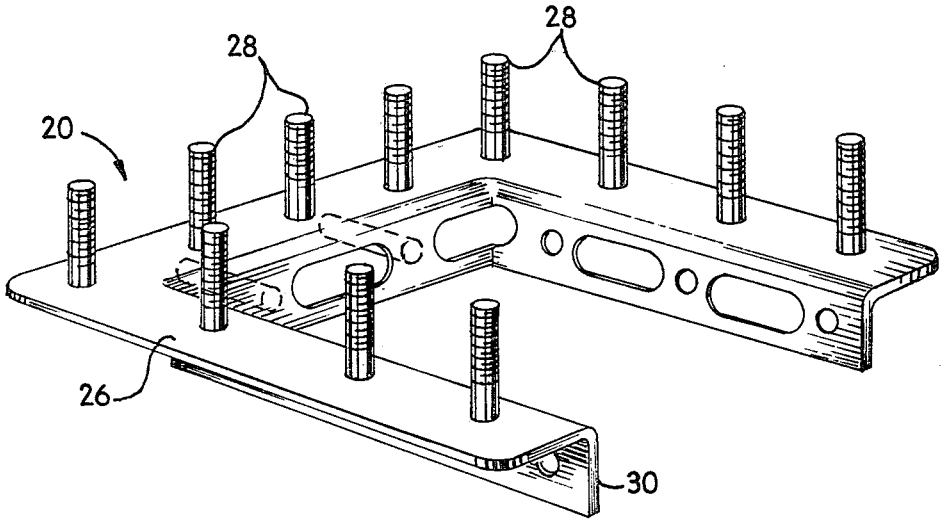
FIG. 3 is an enlarged perspective view of a component of the FIGS. 1 and 2 structure.

Referring now to FIG. 3, it may be noted that enlarged openings 54 are formed in the vertical flange 30 of each bracket 20. Such openings 54, in conjunction with the space, represented at 56 in FIG. 1, between the flange 30 and the core assembly 12 permits ready access to the corner area of the headsheet 14 and core assembly 12 for any repair thereof which might be required to be made.

With the above arrangement, for a repair operation, the tank-to-headsheet sealed joint need not be broken, as has heretofore been the case when the side channel typically was bolted directly to the headsheet and the tank flange assembly. By virtue of the vertical slots 38 formed in the mounting flanges 40 of the side channel 36, after assembly and test of the tank, headsheet and core assembly, the side channels may be readily mounted on the brackets 20, substantially regardless of the tolerances of the headsheet to headsheet dimensions.

INDUSTRIAL APPLICABILITY

It should be apparent that the invention provides an improved bolted radiator arrangement for permitting repair of corner leaks which may occur in the radiator assembly, without having to partially disassemble the tank and headsheet in order to accommodate a side channel removal. Furthermore, the side channels are mounted after testing, without the possibility of causing some prestressing, resulting in subsequent leakage therebetween.

It should also be apparent that the invention provides an improved, non-stressing, bolted radiator arrangement, wherein the side channels and their respective mounting brackets fit within the periphery of the tank flange, thereby maintaining the overall width and depth of the conventional radiator.

While but one general embodiment of the invention has been shown and described, other modifications thereof are possible.

The embodiments of the invention in which an exclusive property or privilege is claimed are defined as follows:

1. A radiator comprising a core assembly, a headsheet mounted on each of the top and bottom ends of said core assembly, a tank bolted to each headsheet with sealing means therebetween, connector members including a horizontal flange portion mounted on said headsheet at each corner of said radiator and a vertical flange portion extending adjacent said core assembly, means associated with said connector members for providing access inside said vertical flange portion in order to permit repair of corner leaks, and a side channel removeably and adjustably mounted on said vertical flange portion of each upper and lower connector member, with removal thereof being possible without having to break the tank-to-headsheet sealed joint.

2. The radiator described in claim 1, wherein a plurality of vertical slots are formed in said side channel for cooperation with mounting means on said vertical flange portions of said brackets, thereby providing for assembly on said brackets without any prestressing of the tank-to-headsheet sealed joint.

3. The radiator described in claim 1, wherein each of said connector members is a "U" shaped bracket adaptable to being fitted around said core assembly.

4. The radiator described in claim 3, wherein said vertical flange portions of said brackets are spaced a predetermined distance apart from said core assembly.

5. The radiator described in claim 4, wherein said access means includes a plurality of spaced openings formed in each of said vertical flange portions, providing access therethrough for repairing corner leaks at the sealed joint between said headsheet and said core assembly.

6. A radiator comprising a core assembly, a headsheet mounted on each of the top and bottom ends of said core assembly, a tank bolted to the outer surface of each headsheet with a sealing gasket therebetween, a bracket including a horizontal flange portion bolted to the inner surface of said headsheet at each corner of said radiator, and a vertical flange portion adjacent and spaced apart from said core assembly providing access therebetween, enlarged openings formed in said vertical flange portions providing access therethrough, and a side channel mounted via vertical slots on the vertical flange portions of each upper and lower bracket, said side channels being adapted to being removed from said brackets to permit repair of corner leaks through said elongated openings and in the space between said vertical flange portions and said core assembly, and being reassembled on said brackets without disturbing or prestressing the bolted tank-headsheet-bracket connections.

* * * * *